US007124449B2

(12) United States Patent
Sutter et al.

(10) Patent No.: US 7,124,449 B2
(45) Date of Patent: Oct. 24, 2006

(54) PROTECTIVE HELMET ASSEMBLY HAVING LIGHTWEIGHT SUSPENSION SYSTEM

(75) Inventors: Brad Sutter, Exeter, PA (US); Joseph Slivinski, Peckville, PA (US); Deborah Panna, Throop, PA (US)

(73) Assignee: Gentex Corporation, Carbondale, PA (US)

( * ) Notice: Subject to any disclaimer, the term of this patent is extended or adjusted under 35 U.S.C. 154(b) by 0 days.

(21) Appl. No.: 10/812,693

(22) Filed: Mar. 30, 2004

(65) Prior Publication Data

US 2005/0217006 A1 Oct. 6, 2005

(51) Int. Cl.
*A42B 1/22* (2006.01)

(52) U.S. Cl. ..... 2/418; 2/416; 2/181

(58) Field of Classification Search ..... 2/6.6, 2/411, 412, 414, 415, 416, 417, 418, 419, 2/420, 421, 909, 181, DIG. 11
See application file for complete search history.

(56) References Cited

U.S. PATENT DOCUMENTS 2,359,387 A * 10/1944 Riddell ..... 2/6.6
2,400,077 A * 5/1946 Dauster ..... 2/183
2,455,797 A * 12/1948 Myers et al. ..... 2/414
2,758,306 A * 8/1956 Grancsay et al. ..... 2/419
2,769,176 A * 11/1956 Grancsay et al. ..... 2/421
2,814,043 A * 11/1957 Alesi ..... 2/421
2,846,683 A * 8/1958 Dye et al. ..... 2/421
2,861,271 A * 11/1958 Lee et al. ..... 2/416
3,111,674 A * 11/1963 Marietta ..... 2/414
3,153,792 A * 10/1964 Marietta ..... 2/414
3,183,522 A * 5/1965 Groot ..... 2/418
3,258,010 A * 6/1966 Austin et al. ..... 128/201.25
3,280,406 A * 10/1966 Immel ..... 2/181
3,387,304 A * 6/1968 Simpson et al. ..... 2/419
3,510,879 A * 5/1970 Webb ..... 2/416
3,551,965 A * 1/1971 Gordon ..... 24/543
3,600,713 A * 8/1971 Holt ..... 2/83
3,609,765 A * 10/1971 Molitoris ..... 2/418
3,619,814 A * 11/1971 Aileo ..... 2/418
3,685,055 A * 8/1972 Militello ..... 2/181.4
3,714,668 A * 2/1973 Mirabella ..... 2/419
3,818,508 A * 6/1974 Lammers et al. ..... 2/412
3,852,821 A * 12/1974 Mickel ..... 2/415
3,897,596 A 8/1975 Aileo et al.
3,906,548 A * 9/1975 Kallis ..... 2/181.4
3,994,023 A 11/1976 Aileo et al.
4,263,679 A * 4/1981 Erlendson ..... 2/421
4,274,157 A * 6/1981 Boden ..... 2/181.4
4,453,277 A * 6/1984 Durand et al. ..... 2/416

(Continued)

OTHER PUBLICATIONS

Gentex Corp. "Law Enforcement Ballistic Protective Helmet Fitting, Operation and Replacement Instructions", 19 pages, Feb. 2000, Carbondale, PA.

*Primary Examiner*—Rodney M Lindsey
(74) *Attorney, Agent, or Firm*—Keusey, Tutunjian & Bitetto, P.C.

(57) ABSTRACT

There is provided a protective helmet assembly that includes a shell, a suspension band, and an adjustable headband and a crown pad. The shell is constructed from at least PARA-ARAMID to provide ballistic protection. The suspension band is attached to the shell. The adjustable headband and the crown pad collectively adjust to a shape of a head of a user while maintaining the head of the user in a non-direct-contact relationship with the shell. The adjustable headband and the crown pad each have a plurality of screw less connectors for directly securing the adjustable headband and the crown pad to the suspension band without screws.

25 Claims, 7 Drawing Sheets

U.S. PATENT DOCUMENTS 4,656,674 A * 4/1987 Medwell ..... 2/410
RE32,569 E * 1/1988 Aileo et al. ..... 2/416
4,978,210 A * 12/1990 Lundbeck ..... 351/157
5,088,130 A * 2/1992 Chiarella ..... 2/411
5,123,121 A * 6/1992 Broersma ..... 2/421
5,584,073 A 12/1996 Radzelovage et al.
5,774,900 A * 7/1998 Wu et al. ..... 2/411
5,794,272 A * 8/1998 Workman et al. ..... 2/421
6,279,172 B1 8/2001 Epperson et al.
6,311,338 B1 * 11/2001 Galet ..... 2/421

* cited by examiner

PROTECTIVE HELMET ASSEMBLY HAVING LIGHTWEIGHT SUSPENSION SYSTEM

BACKGROUND OF THE INVENTION

1. Field of the Invention

This invention relates to a protective helmet assembly having a lightweight suspension system for use in military, law enforcement, and other applications requiring protection of the head against ballistic and other impacts.

2. Background of the Invention

Various forms of military helmets and the like are known in the prior art. These helmets are constructed to protect the wearer's head against injury. In addition, modern combat requires military personnel to utilize certain helmet-mounted electronic systems, for example, night vision systems and helmet mounted displays.

Various suspension systems for supporting a military helmet relative to the head of a wearer are also known in the art. Typical suspension systems of the prior art are disclosed in U.S. Pat. Nos. 3,897,596 and 3,994,023. In each of the suspensions shown in these patents, a rigid suspension frame is formed with an upwardly opening outer peripheral channel for receiving the lower edge of the shell of the helmet. Straps of a crown structure for receiving the top of the wearer's head are secured to the suspension frame at spaced locations there around, while pads cooperating with one another to form a peripheral headband are independently secured to the same suspension frame.

Although such suspensions satisfactorily achieve the objects of their invention, certain areas remain for improvement. The need for improved suspensions arises particularly in the case of heavier, ballistic-impact-resistant helmets and also when adding ancillary equipment to a helmet. These heavier helmets create the need for a suspension system that permits adjustment of the helmet's center of gravity relative to the wearer, as well as providing increased stability and retention of the helmet on the head. Further, the suspension system should minimize pressure points on the head that might cause discomfort. Aside from these requirements arising from the use of heavier ballistic-type helmets, it is also desirable that a suspension system accommodate a range of head sizes and allow easy servicing or replacement of components.

U.S. Pat. No. 5,584,073 discloses an integrated helmet system having an outer shell and an inner helmet subassembly. The inner helmet subassembly has a shell and a headband. The shell has a frame portion that extends around the head of a wearer. The headband supports the frame in an adjustable relationship to position an inner surface of a visor relative to the eyes of a wearer. Non-rear crown straps are secured at their lower ends to the frame and through and to the headband. Rear crown straps are secured at their lower ends to a shell of the inner helmet assembly. The upper ends of the non-rear and rear crown straps are stitched to form loops through which a cord is passed. The ends of the cord are tied to retain the crown strap loops over the crown pad. The adjustment of the cord length adjusts the vertical position of the headband and frame relative to the head of the wearer. However, an inner and outer helmet arrangement is neither necessary nor feasible in many circumstances.

Accordingly, it would be desirable and highly advantageous to have a protective helmet assembly with a lightweight suspension system that is especially suitable for use with heavier, ballistic-impact-resistant materials, that permits adjustment of the helmet's center of gravity relative to the wearer, that provides increased stability and retention of the helmet on the head, that minimizes pressure points on the head, that accommodates a range of head sizes, and that allows easy servicing or replacement of components.

SUMMARY OF THE INVENTION

The problems stated above, as well as other related problems of the prior art, are solved by the present invention, a protective helmet assembly having a lightweight suspension system.

According to an aspect of invention, there is provided a protective helmet assembly that includes a shell, a suspension band, and an adjustable headband and a crown pad. The shell is constructed from at least PARA-ARAMID to provide ballistic protection. The suspension band is attached to the shell. The adjustable headband and the crown pad collectively adjust to a shape of a head of a user while maintaining the head of the user in a non-direct-contact relationship with the shell. The adjustable headband and the crown pad each have a plurality of screw less connectors for directly securing the adjustable headband and the crown pad to the suspension band without screws.

These and other aspects, features and advantages of the present invention will become apparent from the following detailed description of preferred embodiments, which is to be read in connection with the accompanying drawings.

BRIEF DESCRIPTION OF THE DRAWINGS

FIGS. 2–7 all being views looking through a helmet shell into the interior of the protective helmet assembly.

DETAILED DESCRIPTION OF THE INVENTION

The present invention is directed to a protective helmet assembly having a lightweight suspension system. The protective helmet assembly provides ballistic and other impact protection to a wearer. The suspension system permits adjustment of the helmet's center of gravity relative to the wearer, provides increased stability and retention of the helmet on the head, minimizes pressure points on the head, accommodates a range of head sizes, and allows easy servicing or replacement of components.

Figure 1:
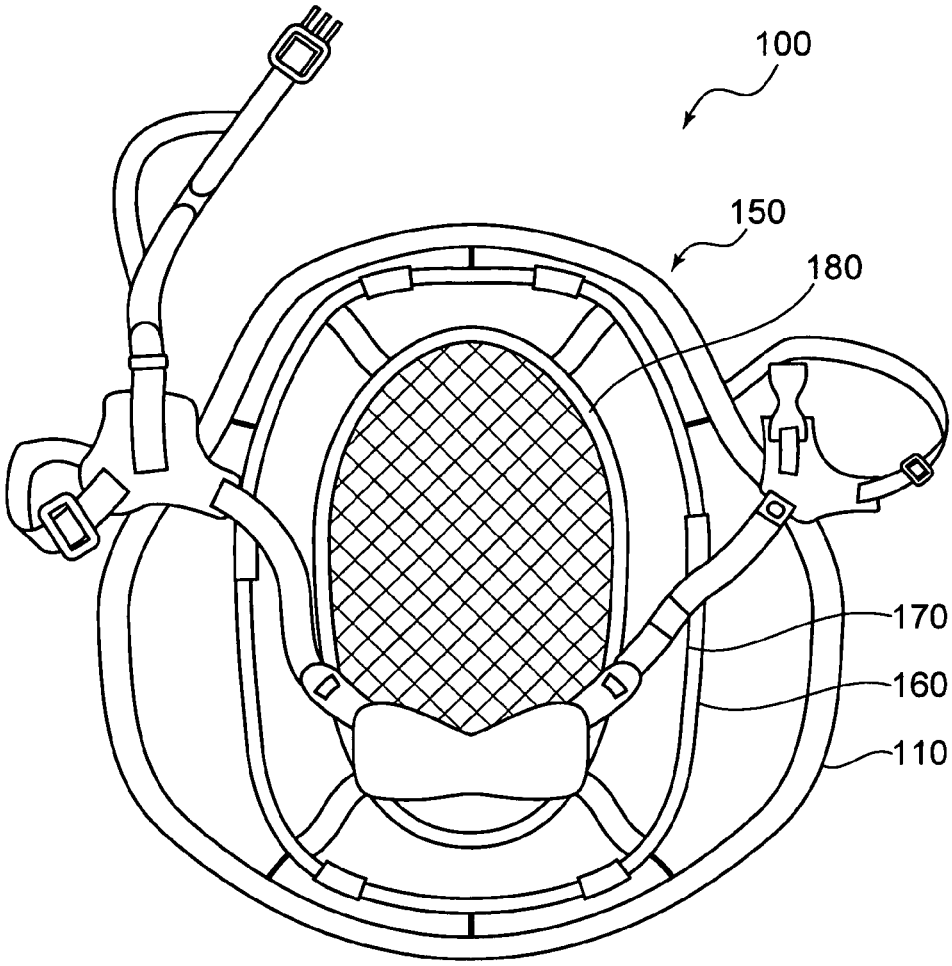
FIG. 1 is a diagram illustrating a protective helmet assembly looking up into the interior of the protective helmet assembly and where the right side of the helmet is on the right side of the diagram, according to an illustrative embodiment of the present invention.

FIG. 1 is a diagram illustrating a protective helmet assembly 100, according to an illustrative embodiment of the present invention. The protective helmet assembly 100 includes a shell 110. The protective helmet assembly 100 further includes a lightweight suspension system 150. The suspension system 150 has a suspension band 160 attached to shell 110. The suspension system 150 further includes a headband 170 and a crown pad 180 directly secured to suspension band 160 without screws.

Figure 2:
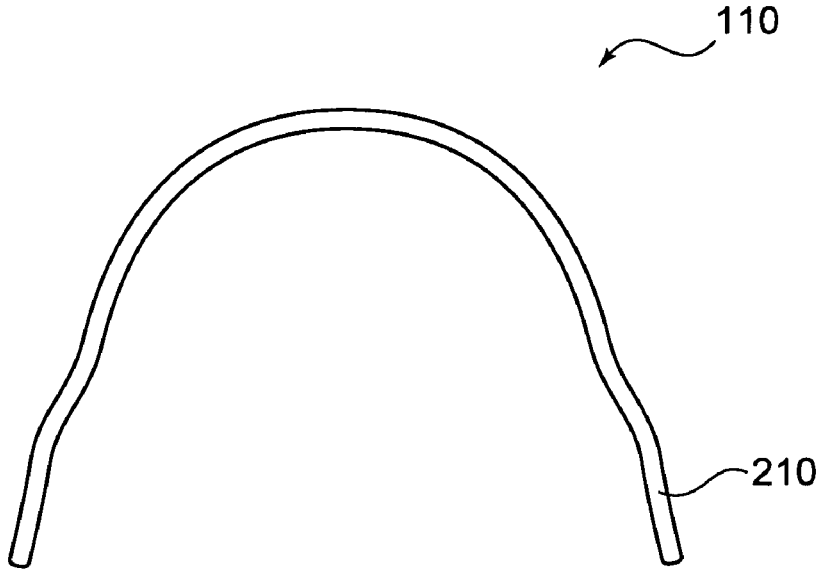
FIG. 2 is a diagram illustrating a cross-sectional view of the shell of the protective helmet assembly of FIG. 1, according to an illustrative embodiment of the present invention.

FIG. 2 is a diagram illustrating a cross-sectional view of the shell 110 of the protective helmet assembly 100 of FIG. 1, according to an illustrative embodiment of the present invention. The shell 110 is fabricated from at least PARA-ARAMID 210 to provide ballistic protection. Shell 110 can be constructed using a woven material and a Poluvinylbutyral/Phenolic Resin system. Once construction, the shell 110 can be primed using a paint or a Type II Aliphatic Polyurethane.

Figure 3:
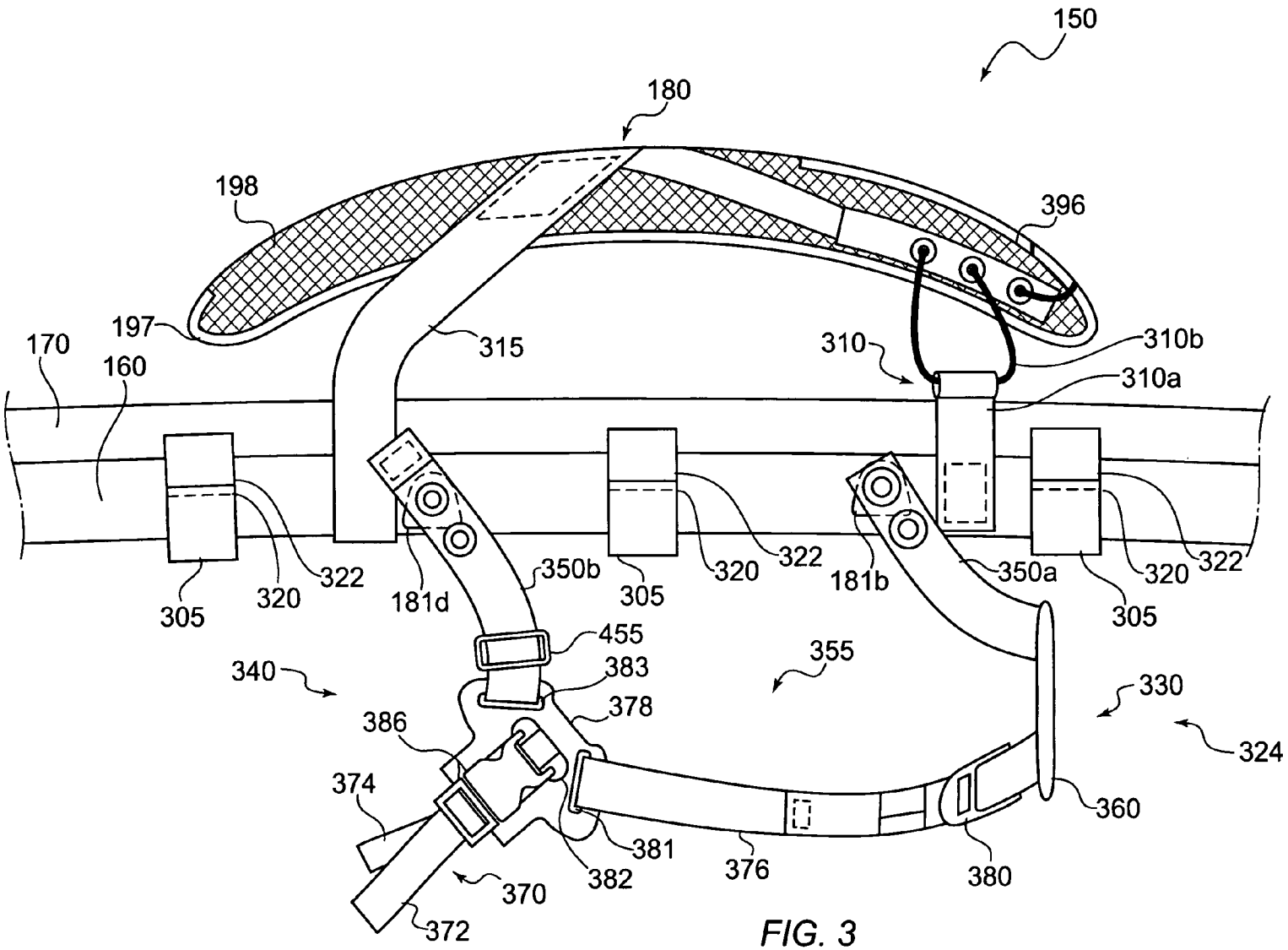
FIG. 3 is a diagram illustrating a right side view of the lightweight suspension system of FIG. 1, according to an illustrative embodiment of the present invention.

FIG. 3 is a diagram illustrating a wearer's left side view of lightweight suspension system 150 of FIG. 1, according to an illustrative embodiment of the present invention. As noted above, suspension system 150 has suspension band 160 attached to shell 110 (not shown in FIG. 3) and further has headband 170 and crown pad 180 directly secured to suspension band 160.

The headband 170 is directly secured to suspension band 160 via loops 305. Each of loops 305 may be formed from a strap that is folded into a loop. Each of loops 305 may be formed of nylon and include a hook-and-loop fastener 320. However, it is to be appreciated that loops 305 may be formed of any suitable material and may include any suitable type of fastener.

Figure 4:
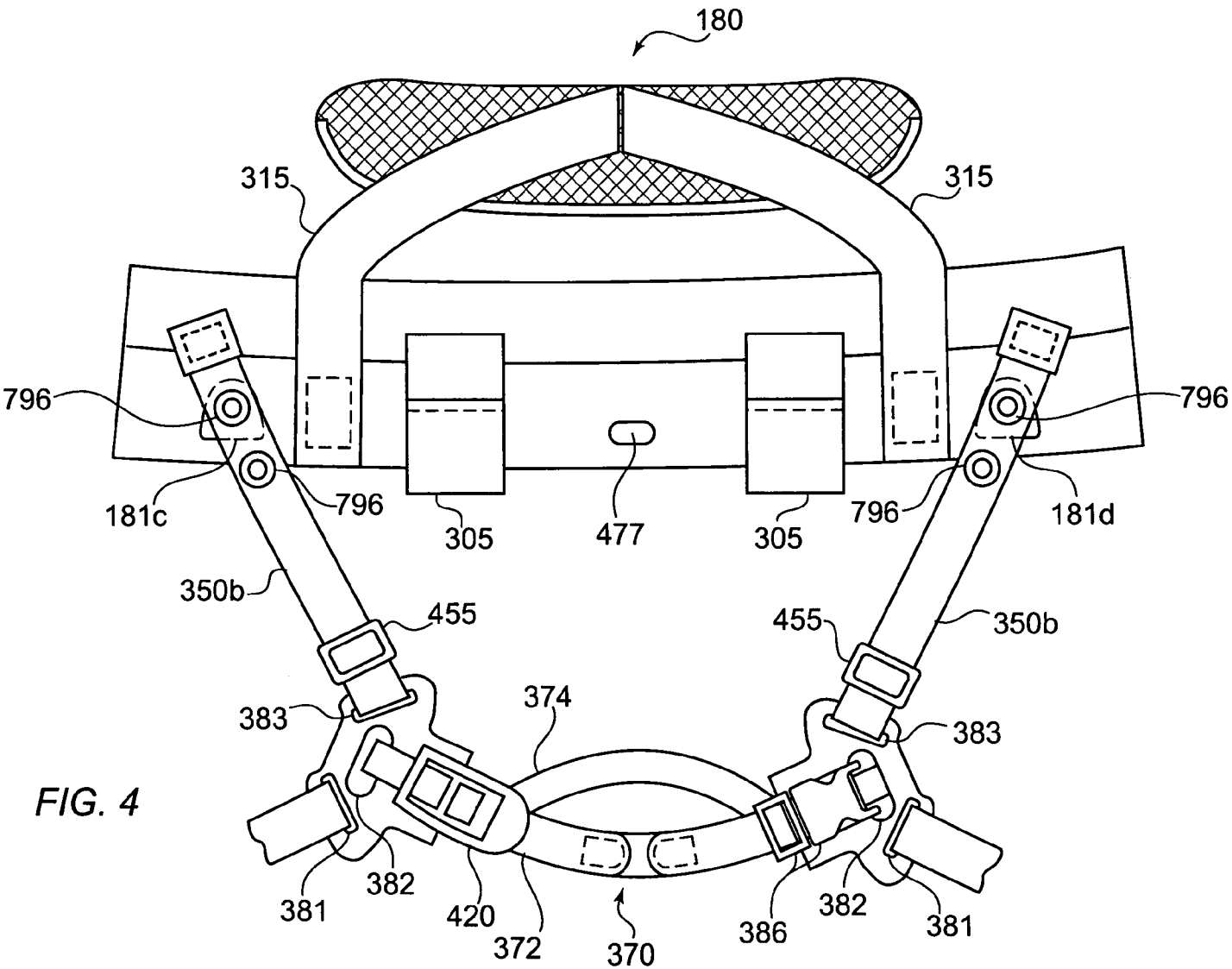
FIG. 4 is a diagram illustrating a front view of the lightweight suspension system of FIG. 1, according to an illustrative embodiment of the present invention.

For each of the loops 305 that attaches headband 170 to suspension band 160, another hook and loop tab 322 is employed "underneath" loop 305 as part of headband 170. Thus, for each of the loops 305, there is hook and loop fastener 320 on the headband 170 for wrapping around suspension band 160 and another hook and loop fastener tab 322 that is under a given one of the loops 305 when that loop is fastened. At the two front portions of loops 305 (as shown in FIG. 4), there is a portion of hook and loop material fastened to suspension band 160 on the side of the band that faces the interior of the shell 110 (not shown in FIG. 4). These two positions of hook and loop material anchor the headband 170 to the suspension band 160 and thereby prevent rotation of the headband 170 within the protective helmet assembly.

The crown pad 180 is directly secured to suspension band 160 via loops 310 and straps 315. The loops 310 and straps 315 that attach crown pad 180 to suspension band 160 may be formed from nylon or any other suitable material. The crown pad 180 includes a mesh portion 198 and a reenforced edge portion 197. The mesh portion 198 provides load distribution.

The loops 310 that attach crown pad 180 to suspension band 160 include first rear loops 310*a* and second rear loops 310*b*. The first rear loops 310*a* are attached to suspension band 160, and the second rear loops 310*b* are attached to first rear loops 310*a* and crown pad 180. The first rear loops 310*a* may be formed of straps and the second rear loops 310*b* may be formed of cord. However, it is to be appreciated that the loops 310*a* and 310*b* may be formed of any suitable configurations including but not limited to straps and cord.

Figure 7:
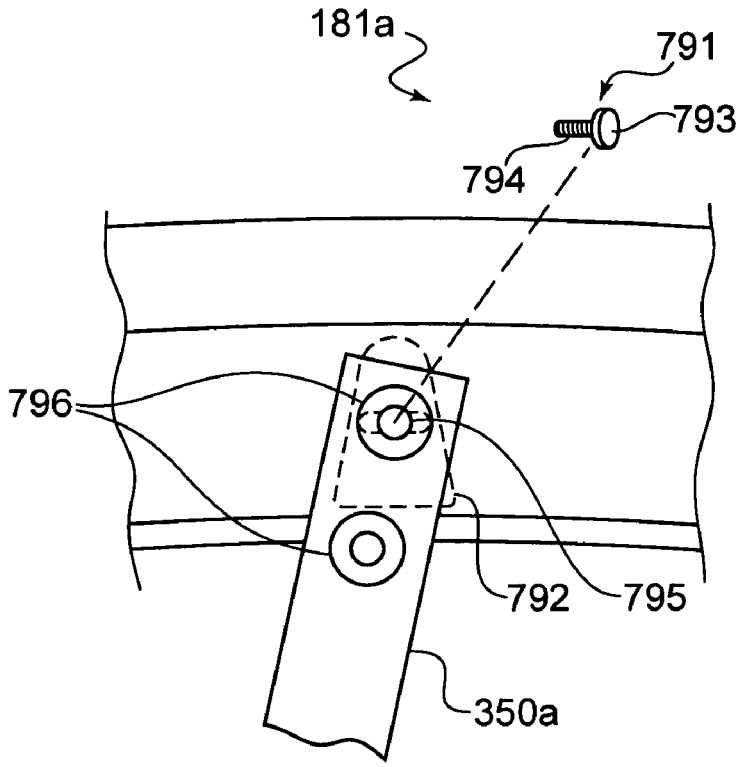
FIG. 7 is a diagram illustrating a fastener for connecting the suspension band, the nape pad, and the chinstrap subassembly of the lightweight suspension system to the helmet shell, according to an illustrative embodiment of the present invention.

The suspension band 160 is attached to shell 110 via fasteners 181. Referring now to FIG. 7, a diagram is provided illustrating one of the fasteners 181*a* of FIG. 1, according to an illustrative embodiment of the present invention. The fastener 181*a* connects, at the least, suspension band 160 of suspension system 150 to shell 110. The metal fastener 181*a* may include a screw 791 and a clip 792. The screw 791 may have a head portion 793 and a threaded portion 794. The clip 792 is for receiving threaded portion 794 of screw 791 and for providing a surface of adjustable tension between at least suspension band 160 and shell 110.

The clip 792 may include a raised portion 795 for receiving threaded portion 794 of screw 791 and for allowing one or more grommets 796 to pass there around. The grommets 796 may be located on any straps corresponding to a chinstrap or nape pad (i.e., first sets of nylon straps 350*a* and 350*b*) as described below. As shown in FIG. 4, the suspension band 160 includes apertures 477 for allowing raised portion 795 of clip 792 and threaded portion 794 of screw 791 to at least partially pass there through. That is, the apertures 477 allow for the raised portion 795 of clip 792 inserted from the innermost side of the suspension band 160 (and through a corresponding grommet 796) to mate with the threaded portion 794 of screw 791 inserted from the other outside of helmet shell 110 and into the other side of the suspension band 160.

Figure 5:
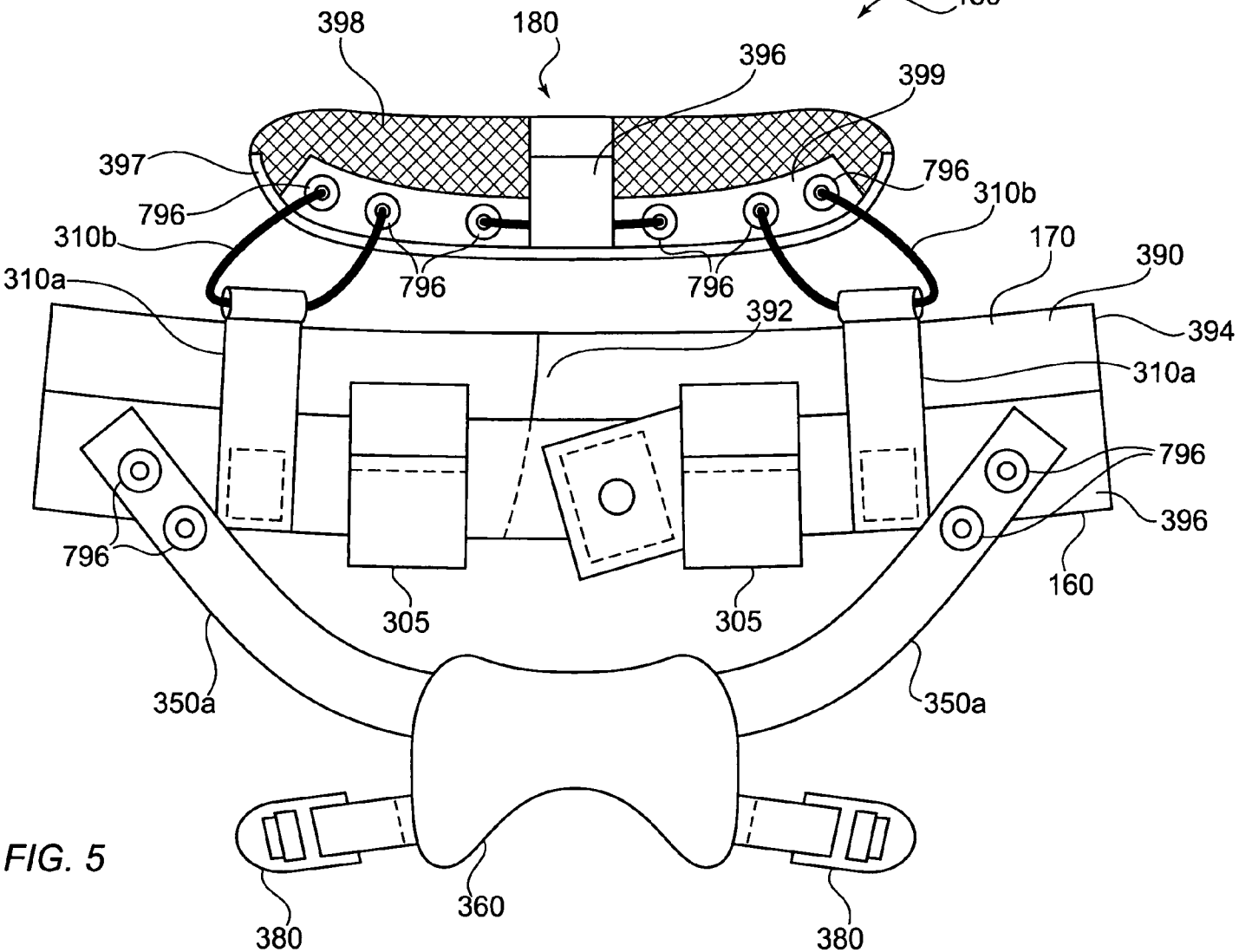
FIG. 5 is a diagram illustrating a rear view of the lightweight suspension system of FIG. 1, according to an illustrative embodiment of the present invention.
Figure 6:
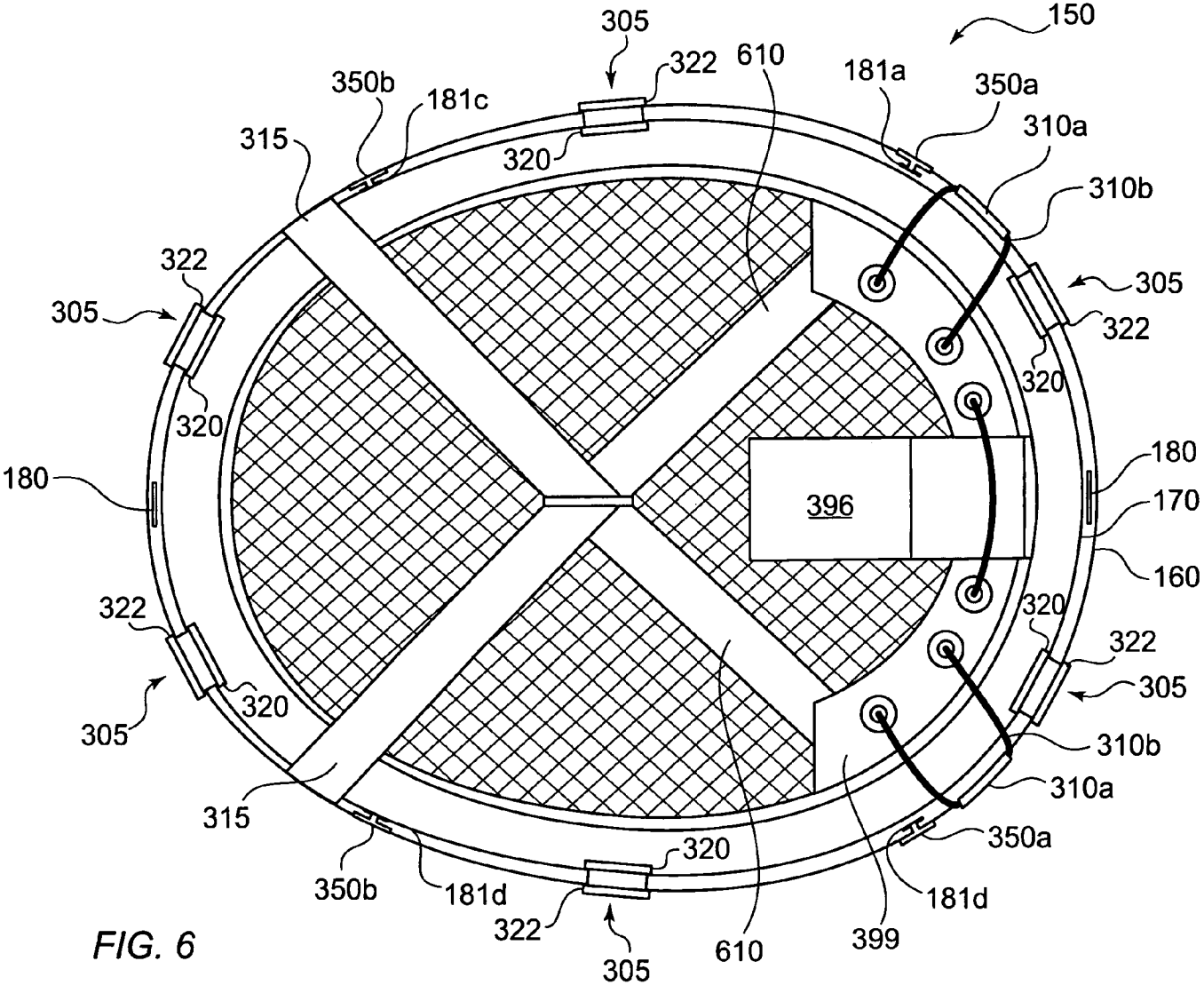
FIG. 6 is a diagram illustrating top view of the lightweight suspension system of FIG. 1, according to an illustrative embodiment of the present invention.

Referring again to FIG. 3, as well as to FIGS. 1–2 and 4–6, the suspension system 150 further includes a nap pad and chinstrap subassembly 324. FIGS. 4–6 are diagrams illustrating a front, a rear, and a top view of the lightweight suspension system 150 of FIG. 1, respectively, according to an illustrative embodiment of the present invention.

The nap pad and chinstrap subassembly 324 includes a nape pad subassembly 330 and a chinstrap subassembly 340. The nape pad subassembly 330 is for providing fore and aft positioning of the protective helmet assembly 100 relative to a nape of a neck of a wearer. The nape pad subassembly 330 may be attached to shell 110 via at least some of the metal fasteners 181*a*, 181*b*. The metal fasteners 181 maintain suspension band 160 in a fixed position with respect to shell 110 while at least some of the metal fasteners 181*a*, 181*b* provide adjustment of the fore and aft positioning of protective helmet assembly 100 relative to the nape of the neck of the wearer.

The chinstrap subassembly 340 is for securing a position of protective helmet assembly 100 relative to a chin of a wearer. The chinstrap subassembly 340 is attached to shell 110 via at least some of the metal fasteners 181*c*, 181*d*. The metal fasteners 181 maintain suspension band 160 in a fixed position with respect to shell 110 while at least some of the metal fasteners 181*c*, 181*d* provide adjustment of the position of protective helmet assembly 100 relative to the chin of the wearer.

The nape pad subassembly 330 and chinstrap subassembly 340 respectively include a nap pad portion 360 and a chinstrap portion 370 joined together using a coupling 355. The nape pad portion 360 may be constructed of at least leather.

As shown in FIG. 4, the chinstrap portion 370 includes a first nylon strap 372 for securing under the chin and a second nylon strap 374 connected to first nylon strap 372 for securing in front of the chin.

As shown in FIG. 3, the coupling 355 includes a first set of straps 376, a first set of strap joiners 378, and a first set of strap clips 380. Each of strap joiners 378 has a first connection point 381, a second connection point 382, and a third connection point 383. Each of straps 376 is respectively connected to one of the strap clips 380 and to the first connection point 381 of one of the strap joiners 378, with adjustment provided by the strap clip 380.

As shown in FIG. 4, the second connection point 382 of each strap joiner 378 is respectively connected to the chinstrap portion 370 via a quick release latch 386 (positioned on the left side of wearer's head) and a strap clip. The quick release latch 386 provides a quick release of the chinstrap portion 370 from the chin of the wearer.

The third connection point 383 of each of strap joiners 378 is respectively connected to shell 110 via straps 350*b*, adjustment clips 455, and at least some of the metal fasteners 181*c,d*.

The nape pad subassembly 330 includes nylon straps 350*a* that are attached to shell 110 via at least some of the metal fasteners 181*a,b*.

The headband 170 includes a nylon band 390 and a hook-and-loop fastener 392 for adjusting a circumference of the nylon band 390. The headband 170 further includes a leather band 394 for overlaying over a portion of the nylon band 390 that is in contact with the head of a wearer.

The suspension band 160 includes a nylon band 396 as a layer thereof. The suspension band 160 is disposed around an inner surface of shell 110 so as to allow air to pass between suspension band 160 and the inner surface of shell 110.

The crown pad 180 is disposed away from the inner surface of shell 110 to allow air circulation between crown pad 180 and the inner surface of shell 110.

The crown pad 180 includes an outer leather ring 397 and an inner nylon mesh portion 398. The inner nylon mesh portion 398 is for allowing air to contact the crown portion of the head of a wearer. Moreover, the crown pad 180 includes a hook and loop fastener 396 and a leather re-enforcement portion 399 having grommets 796 thereon for allowing nylon cord 310*b* to pass there through to adjust the position of the crown pad 180. Additional re-enforcement straps 610 are disposed on the top rear portion of crown pad 180.

Although the illustrative embodiments have been described herein with reference to the accompanying drawings, it is to be understood that the present invention is not limited to those precise embodiments, and that various other changes and modifications may be affected therein by one of ordinary skill in the related art without departing from the scope or spirit of the invention. All such changes and modifications are intended to be included within the scope of the invention as defined by the appended claims.

What is claimed is:

1. A protective helmet assembly, comprising:

a shell constructed from at least para-aramid to provide ballistic protection;

a suspension band attached to the shell;

a headband adjustable to different circumferences connected to the suspension band only at points remote from said suspension band attachment to the shell; and a crown pad connected to the suspension band only at points separate from (i) said suspension band attachment to said shell and (ii) said adjustable headband connections to said suspension band.

2. The protective helmet assembly of claim 1, wherein said shell is constructed from at least one of a woven material and a Polyvinylbutyral/Phenolic resin system.

3. The protective helmet assembly of claim 1, wherein said shell is primed using one of a paint and a Type II Aliphatic Polyurethane.

4. The protective helmet assembly of claim 1, wherein the headband is directly secured to the suspension band via loops and the crown pad is directly secured to the suspension band via loops and straps.

5. The protective helmet assembly of claim 4, wherein each of the loops that attach the headband to the suspension band is formed of nylon and include a hook-and-loop fastener.

6. The protective helmet assembly of claim 1, wherein the suspension band comprises a nylon band.

7. The protective helmet assembly of claim 5, wherein the nylon is in a form of a strap that is folded into a loop.

8. The protective helmet assembly of claim 4, wherein the loops and straps that attach the crown pad to the suspension band are formed of nylon.

9. The protective helmet assembly of claim 4, wherein the loops that attach the crown pad to the suspension band comprise first rear loops and second rear loops, the first rear loops being attached to the suspension band, and the second rear loops being attached to the first rear loops and the crown pad.

10. The protective helmet assembly of claim 9, wherein the first rear loops are formed of nylon straps and the second rear loops are formed of nylon cord.

11. The protective helmet assembly of claim 1, wherein the suspension band is attached to the shell via metal fasteners.

12. The protective helmet assembly of claim 11, wherein at least some of the metal fasteners comprise a screw and a clip, the screw having a head portion and a threaded portion, the clip portion for receiving the threaded portion.

13. The protective helmet assembly of claim 1, further comprising a nape pad for fore and aft positioning of the protective helmet assembly relative to a nape of a neck of a wearer.

14. The protective helmet assembly of claim 13, wherein the suspension band is attached to the shell via metal fasteners, and the nape pad is attached to the shell via at least some of the metal fasteners.

15. The protective helmet assembly of claim 14, wherein the metal fasteners maintain the suspension band in a fixed position with respect to the shell while the at least some of the metal fasteners provide adjustment of the fore and aft positioning of the protective helmet assembly relative to the nape of the neck of the wearer.

16. The protective helmet assembly of claim 1, further comprising a chin strap subassembly for securing a position of the protective helmet assembly relative to a chin of a wearer.

17. The protective helmet assembly of claim 16, wherein the suspension band is attached to the shell via metal fasteners, and the chin strap subassembly is attached to the shell via at least some of the metal fasteners.

18. The protective helmet assembly of claim 17, wherein the metal fasteners maintain the suspension band in a fixed position with respect to the shell while the at least some of the metal fasteners provide adjustment of the position of the protective helmet assembly relative to the chin of the wearer.

19. The protective helmet assembly of claim 1, wherein the suspension band is attached to the shell via metal fasteners, and the assembly further comprises a nape pad and chin strap subassembly attached to the shell via at least some of the metal fasteners.

20. The protective helmet assembly of claim 19, wherein the metal fasteners maintain the suspension band in a fixed position with respect to the shell while the at least some of the metal fasteners provide adjustment of a position of the nape pad and chin strap subassembly.

21. The protective helmet assembly of claim 1, wherein the crown pad is disposed away from the inner surface of the shell to allow air circulation between the crown pad and the inner surface of the shell.

22. The protective helmet assembly of claim 1, wherein the crown pad comprises an outer leather ring and an inner nylon mesh portion, the inner mesh portion for allowing air to contact a crown of a wearer.

23. The protective helmet assembly of claim 1, wherein the suspension band is disposed around an inner surface of the shell so as to allow air to pass between the suspension band and the inner surface of the shell.

24. The protective helmet assembly of claim 1, wherein the adjustable headband is adapted to be directly secured to the suspension band so as to form an adjustable portion that adjusts to the shape of the head of the user independent of the suspension band and the shell.

25. The protective helmet assembly of claim 1, wherein the adjustable headband is capable of being arranged within the protective helmet assembly so as to provide a readily adaptable portion away from the plurality of connectors.

* * * * *